US008733892B2

(12) United States Patent
Duchene et al.

(10) Patent No.: US 8,733,892 B2
(45) Date of Patent: May 27, 2014

(54) INK-JET PRINTING DEPOSITION METHOD

(75) Inventors: Julien Duchene, Charenton-le-Pont (FR); Stéphane Perrot, Charenton-le-Pont (FR); Sylvie Vinsonneau, Charenton-le-Pont (FR)

(73) Assignee: Essilor International (Compagnie Generale d'Optique), Charenton-le-Pont (FR)

( * ) Notice: Subject to any disclaimer, the term of this patent is extended or adjusted under 35 U.S.C. 154(b) by 0 days.

(21) Appl. No.: 13/637,330

(22) PCT Filed: Mar. 22, 2011

(86) PCT No.: PCT/FR2011/050601

§ 371 (c)(1),
(2), (4) Date: Sep. 25, 2012

(87) PCT Pub. No.: WO2011/121209

PCT Pub. Date: Oct. 6, 2011

(65) Prior Publication Data

US 2013/0016159 A1 Jan. 17, 2013

(30) Foreign Application Priority Data

Mar. 30, 2010 (FR) ..... 10 52322

(51) Int. Cl.
*B41J 2/165* (2006.01)

(52) U.S. Cl.
USPC ..... 347/37

(58) Field of Classification Search
None
See application file for complete search history.

(56) References Cited

U.S. PATENT DOCUMENTS

| | | | | |
|---|---|---|---|---|
| 7,014,289 | B1 | 3/2006 | Matsuda | |
| 2002/0008730 | A1 | 1/2002 | Mitsuzawa | |
| 2004/0233246 | A1 | 11/2004 | Takeushi | |
| 2007/0229559 | A1 | 10/2007 | Oku | |
| 2008/0143768 | A1 * | 6/2008 | Veenstra et al. | 347/12 |
| 2008/0192074 | A1 | 8/2008 | Dubois et al. | |
| 2009/0051944 | A1 | 2/2009 | Bracke et al. | |

* cited by examiner

*Primary Examiner* — Alejandro Valencia
(74) *Attorney, Agent, or Firm* — Seed IP Law Group PLLC

(57) ABSTRACT

The invention relates to an ink-jet printing deposition method including a compensation of deviations ($\delta l_1$, $\delta l_2$, $\delta l_3$, . . . ) of ejection nozzles (1, 2, 3 . . . ) carried by a printing head (10). To this end, the deviations are measured first at the moment of the deposition, and then, during the deposition, each nozzle is activated when it shows a shift in relation to the point on a support where the substance is to be deposited, substantially opposite the deviation of said nozzle. Said depositions carried out in this way do not comprise accidental Moiré patterns.

13 Claims, 4 Drawing Sheets

INK-JET PRINTING DEPOSITION METHOD

The present invention relates to a deposition method for ink-jet printing.

Ink-jet printing methods are well known and widely used, not only for printing text or images on surfaces of all types, but also for many other applications. They consist of displacing a movable head relative to a receiving medium, with the head having at least one nozzle that is controlled so that it ejects predefined amounts of a substance at controlled moments during the displacement of the head. Each nozzle is aimed at the medium, so that the ejected amounts of substance reach the medium at points of impact that are initially determined. The medium is also adapted so that the amount of substance received at a point remains at the location of that point, without any subsequent diffusion or migration of the substance on the medium.

The substance deposited by such a method may vary in appearance and type, depending on the application concerned. Examples include ink, glue, index liquid, powder, etc.

The head may be equipped with several nozzles to increase pattern print speed. These nozzles may be activated independently of each other and at the same time. Most often, they are placed on the head in one or more oblique rows or columns.

Also, several different technologies exist for the nozzles, depending on the substance to be deposited. As examples, there are nozzles in which the ejection of an amount of substance is caused by an piezoelectric element, and nozzles in which a bubble is rapidly heated to cause the ejection of the amount of substance.

Ink-jet printing deposition is fast, efficient, and compatible with many different substances. It does have the following disadvantage, however.

During operation, the nozzles carried by the head are at a distance from the surface of the receiving medium. The amounts of substance ejected by the nozzles travel across the space between the nozzle and the medium, called the ejection distance. This ejection distance is constant, at a value which is set or recommended by the head manufacturer.

But, for various reasons related to nozzle manufacturing, the ejection direction for each nozzle is poorly controlled. Each nozzle ejects its amounts of substance in a direction which may be angled relative to the general orientation of the head. This angle in the ejection direction is constant for the same nozzle: all amounts of substance successively ejected by this nozzle have the same ejection direction. Nozzles on the same head may, however, have ejection directions that differ between nozzles. The angle of the ejection direction of a nozzle may be due to the axis of this nozzle being angled relative to the head, or to a defect in the shape of the nozzle outlet, rough spots in the outlet, variations in the surface tension at this outlet, etc. The entire description that follows is limited to considering these types of angle in the ejection direction, which are permanent. It also applies to compensating for unwanted offsets in nozzle outlets relative to the theoretical positions of these outlets on the head. It does not concern temporary variations in the nozzle ejection directions which may be caused by partial obstruction of the outlets. It is known that such temporary variations can be eliminated by nozzle cleaning operations.

Because of the ejection distance between the outlet of each nozzle and the surface of the medium, the angle of the ejection direction results in a deviation between the point of impact on the medium of the ejected amount of substance and the perpendicular projection from the nozzle outlet onto that medium. Various symptoms of this deviation may be apparent, depending on the print pattern and the medium used. In particular, convergent deviations for amounts of substance deposited next to each other may produce dark visible lines perpendicular to the direction of convergence. Conversely, divergent deviations may produce light lines.

Another symptom of deviations in the nozzle ejection directions appears when the medium receiving the substance has a structure to its surface. Unwanted variations appear in the density of the deposition which are due to superimposing each ejection deviation on the medium structure. These variations in the deposition density form moiré patterns, with a period which results from combining the ejection deviations with the medium structure. This moiré period may be about a millimeter, even if the ejection deviations on the medium and the characteristic dimension of the medium are each less than a millimeter or a tenth of a millimeter. Such moiré patterns can therefore be visible and constitute unacceptable aesthetic defects.

To avoid such moiré defects, one proposal has been to determine whether at least one of the nozzles of a head to be used has a deviation in its ejection direction. Such a nozzle with an oblique ejection direction is then neutralized during a later deposition sequence, so that only the nozzles ejecting their amounts of the substance without deviation are used. However, the proportion of nozzles on a deposition head that are neutralized for this reason may be high, significantly reducing the resulting deposition rate obtained with the remaining nozzles.

Under these conditions, an object of the present invention consists of improving the quality of depositions made using an ink-jet printing deposition method.

More specifically, an object of the invention is to eliminate deposition defects resulting from the existence of nozzles in the deposition head that have permanently oblique or misaligned ejection directions.

In particular, an object of the invention is to perform depositions of a higher level of quality onto media which may have a periodic or non-periodic surface structure.

In order to achieve these and other objects, the invention proposes a method for depositing a substance onto a receiving medium for this substance, by means of ink-jet printing using a head which is movable relative to the medium in two directions, transverse and longitudinal, that are perpendicular to each other. The head comprises at least one set of multiple ejection nozzles which are longitudinally offset relative to each other and which are each adapted to eject amounts of the substance in the direction of the medium with a fixed distance between the nozzle and the medium. The method comprises the following steps:

/1/ for each nozzle, measuring a longitudinal deviation between a point of impact on the medium of an amount of substance ejected by this nozzle, and a longitudinal position of the same nozzle when it ejects the amount of substance;

/2/ determining a set of target points longitudinally distributed on the medium, at which amounts of substance are to be deposited;

/3/ for an initial longitudinal offset of the head relative to the medium, parallel to the longitudinal direction, selecting those of the nozzles which have respective longitudinal offsets relative to certain target points, substantially opposite the respective longitudinal deviations of the nozzles, such that the points of impact on the medium of the amounts of substance ejected by the selected nozzles coincide with the corresponding target points parallel to the longitudinal direction;

/4/ repeating step /3/ while varying each time the longitudinal offset of the head beyond the initial offset, by an increment of said longitudinal offset of the head that is less than or equal to the distance between two neighboring target points;

/5/ placing the head facing the medium at the initial longitudinal offset of step /3/, and activating the selected nozzles in accordance with the predetermined amounts of substance to be deposited on the medium at the target points; then /6/ repeating step /5/ for each longitudinal offset of the head used for the iterations of step /3/.

Thus, a method of the invention therefore comprises an initial step for determining the ejection deviation of each nozzle of the head. During a later deposition sequence, the head is successively placed facing the medium at variable offsets, to compensate for the ejection deviations of the nozzles. The only nozzles activated at each offset are those for which compensation is obtained. Thus any ejection deviation of a nozzle is canceled out by offsetting this nozzle relative to the target point at the moment of ejection. The point of impact of the amount of substance ejected onto the medium therefore coincides with the target point.

In this manner, no dark or light line, or more generally no unwanted coverage or empty interval between the depositions for neighboring target points occurs. The quality of the deposition obtained is therefore improved.

Also, no moiré pattern is produced when the medium receiving the substance has a surface structure.

In particular, if the medium has a surface structure that is irregular or random, no moiré pattern is formed even when the target points form a regular grid on the medium surface, if this grid is sufficiently small relative to the pattern of the medium's surface structure.

In addition, all the nozzles of the head can be used in a method according to the invention.

In different embodiments of the invention, the following improvements may be used individually or in any combination:

- the target points may be distributed with a fixed spacing between two neighboring target points parallel to the longitudinal direction;
- the increment used for the longitudinal offset of the head during the iterations of steps /3/ and /5/ may be a divisor of a longitudinal step distance corresponding to a distance between extreme nozzles of the head that are longitudinally opposite, and less than the distance between two neighboring nozzles of the head in the same longitudinal direction;
- the increment used for the longitudinal offset of the head during the iterations of steps /3/ and /5/ may be less than or equal to 10 μm, possibly less than or equal to 1 μm; and
- the head may comprise several sets of nozzles where all nozzles together in each set are offset parallel to the transverse direction, and each iteration of steps /3/ and /5/ is then executed by selecting or activating some of the nozzles in all sets of nozzles, if their respective longitudinal offsets in the longitudinal direction relative to certain target points are substantially opposite the respective longitudinal deviations of these selected nozzles.

In preferred implementations of the invention, a deposition line running parallel to the transverse direction may be made starting from each longitudinal offset of the head. The head is then moved parallel to the transverse direction in each iteration of step /5/, and the nozzles selected for the longitudinal offset of the head which is achieved during this iteration are activated during the transverse movement of the head according to the predetermined amounts of substance to be deposited on the medium at the transverse offset locations, and the nozzles that are not selected for this longitudinal offset of the head are not activated during the transverse movement.

In this case of deposition in transverse rows, the invention may be supplemented to compensate for, in addition to longitudinal ejection deviations, additional ejection deviations which are parallel to the transverse direction. Such compensations for transverse ejection deviations by the nozzles are achieved by adjusting an advance or delay in triggering the ejection of the amount of substance by each nozzle concerned, during the transverse movement of the head as it travels a row. To do this, a method of the invention may be supplemented as follows:

- a transverse deviation is additionally measured for each nozzle in step /1/, between the point of impact on the medium of the amount of substance ejected by the nozzle and the position of this nozzle when it ejects the amount of substance, in the transverse direction;
- the target points which are determined in step /2/ may be offset on the medium parallel to the transverse direction;
- during the transverse movement of the head which occurs in each iteration of step /5/, each nozzle selected for the longitudinal offset of the head occurring in that iteration is activated according to the predetermined amount of substance to be deposited on the medium at one of the target points, at a time in the transverse movement at which the selected nozzle has a transverse offset relative to this target point, which is substantially opposite the transverse deviation of the selected nozzle, such that the point of impact on the medium of the amount of substance ejected by the selected nozzle coincides with the target point simultaneously in both the longitudinal and transverse directions.

To deposit amounts of substance in several transverse rows that are longitudinally offset, a length of the medium in this longitudinal direction is greater than a longitudinal step distance which corresponds to a distance between the extreme nozzles of the head that are longitudinally opposite. Step /6/ is then repeated by adding this longitudinal increment to the longitudinal offsets of the head which are applied during the iterations of step /5/.

Other features and advantages of the invention will be apparent from the following description of some non-limiting implementation examples, with reference to the attached drawings in which:

FIG. 1*a* is a plan view of a substance receiving medium which can be used to implement the invention;

FIG. 1*b* is a cross-sectional view of the medium of FIG. 1*a;*

FIGS. 2*a* and 2*b* are respectively front and profile views of a deposition head which can be used to implement the invention;

FIG. 2*c* shows ejection deviations in the plane of the medium;

For sake of clarity, the dimensions of the elements represented in these figures do not correspond to the actual dimensions or to the ratios between actual dimensions. In addition, the same references used in different figures denote identical elements or those with identical functions.

Figure 1A:
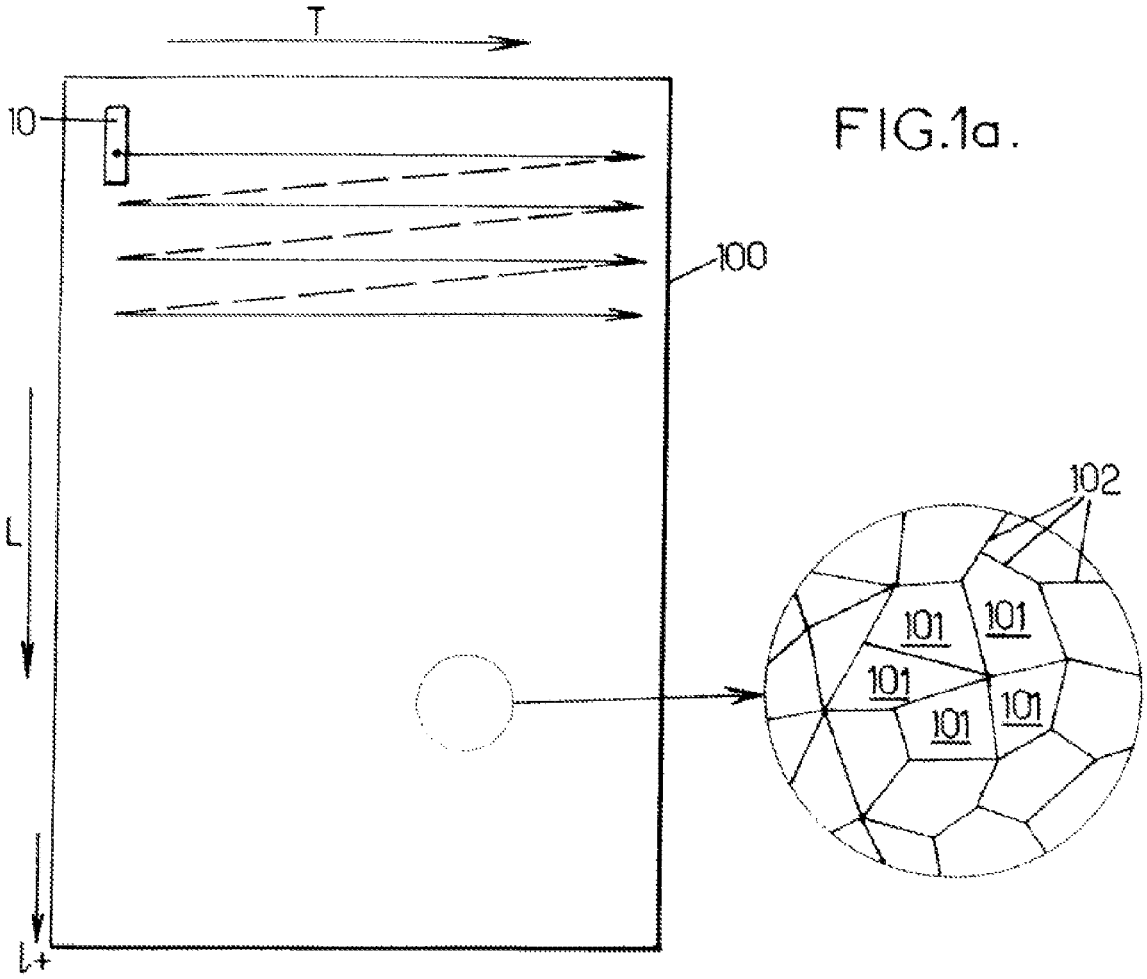

In FIG. 1*a*, a deposition medium 100 is intended to receive predefined amounts of substance at initially determined deposition points on this medium. In the following description, the term "deposition" will be used to indicate the transfer of amounts of substance onto this medium 100 from a head 10 which ejects the substance, it being understood that the term "deposition" includes printing but is more encompassing. To achieve this, the head 10 moves translationally relative to the medium 100, parallel to the receiving surface of the medium while remaining at a constant distance from this surface. The head 10 moves in two directions relative to the medium 100: a transverse direction T and a longitudinal direction L. These two directions may be parallel to the edges of the medium 100. Most often, they are perpendicular to each other, particularly when the medium 100 is rectangular. It is assumed below that the movement of the head 10 facing the medium 100 is a succession of rectilinear paths which are parallel to the transverse direction T, separated by returns of the head 10 to the start of the row. In addition, two successive transverse paths are offset in the longitudinal direction L. When printing text, T corresponds to the direction of the lines of text and L corresponds to the direction the print medium advances perpendicularly to the lines.

The medium 100 may be of any type that is able to receive local amounts of substance which remain affixed without diffusion or migration parallel to the receiving surface of this medium. An amount of substance deposited at a location on the medium 100 definitively remains at that location.

Figure 1B:
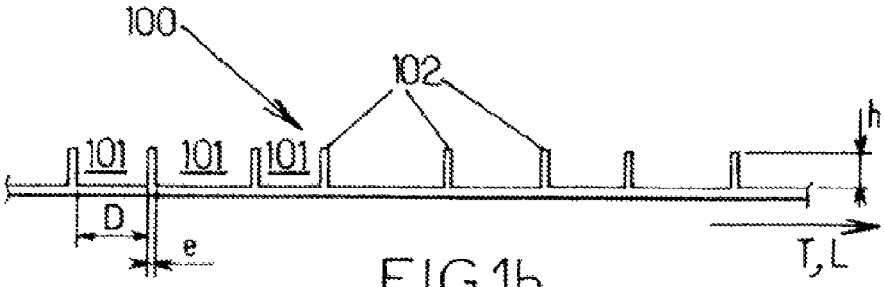

For example, as is represented in the enlarged portion of FIG. 1*a*, the medium 100 may be equipped with cells 101 arranged side by side in a plane parallel to the transverse T and longitudinal L directions, which are adapted to individually contain a variable amount of the substance. The cells 101 may be separated from each other by a network of walls 102, each wall 102 extending perpendicularly to the two directions T and L. In other words, the network of walls 102 partitions the receiving surface of the medium 100 into a set of adjacent cells 101. All the cells 101 are open on the same side of the medium 100, and closed on the opposite side (FIG. 1*b*). During the deposition of the substance on the medium 100, the amounts of substance are projected into the cells 101 via their open sections. In this manner each cell 101 is partially or completely filled with substance, using a deposition method of the invention. The network of walls 102 separating the cells may have any pattern in the plane of the directions T and L. This pattern may be regular, for example with cells 101 that are square, triangular, or hexagonal. Alternatively, the pattern of the network of walls 102 may be irregular, random, or pseudo-random. For the cells 101, the dimension D parallel to the directions T and L may be greater greater than about 40 μm (micrometers), the thickness e of the walls 102 may be between 0.5 and 8 μm, and their height h may be between 10 and 50 μm.

Figure 2C:
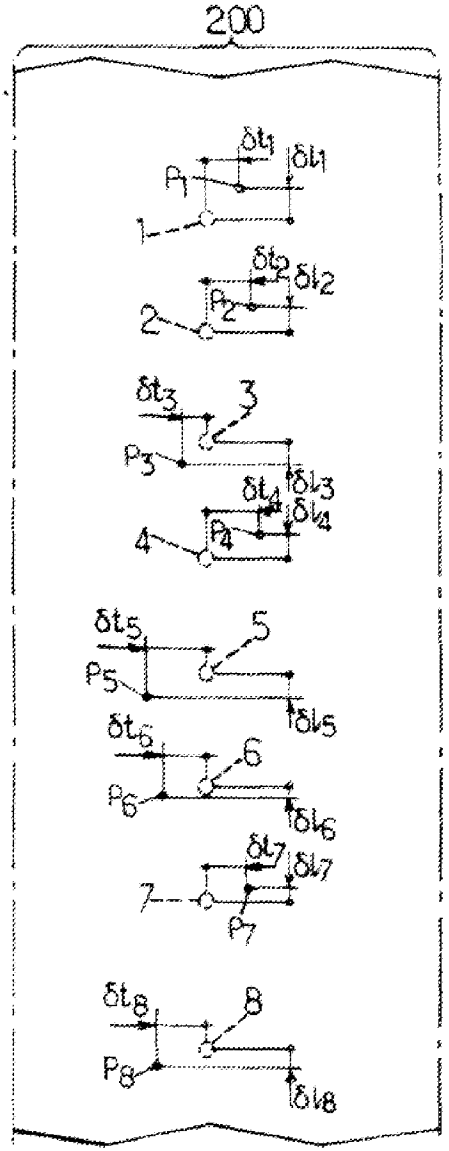
Figure 2B:
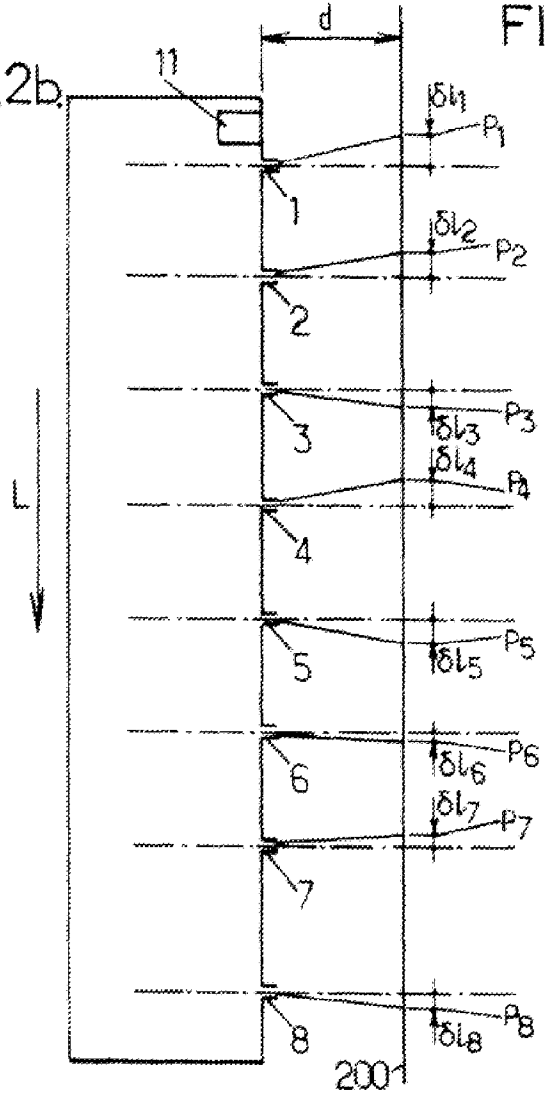
Figure 2A:
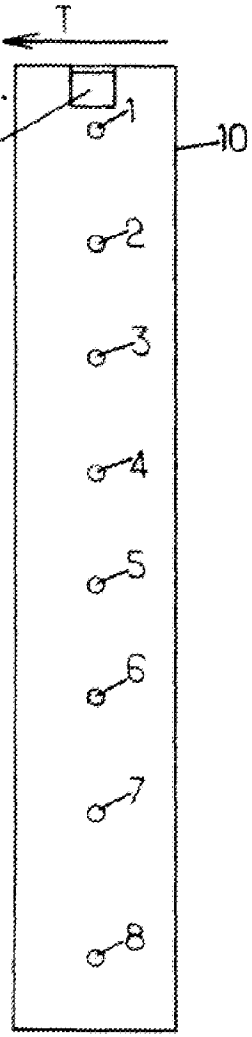

The head 10 comprises a series of nozzles which are offset parallel to the longitudinal direction L, for example 8 nozzles which are labeled 1 to 8 in FIGS. 2*a* and 2*b*. However, it is not necessary for the nozzles 1 to 8 to be aligned parallel to the direction L, but only that they are have offsets relative to each other that each have a component in this direction L. Preferably, the offsets between two successive nozzles are constant. The nozzle technology for controlling and producing the ejection of a known amount of substance may be any technology.

The substance to be deposited on the medium 100 may be any substance compatible with the nozzle technology. It may be ink, a transparent refractive substance, a liquid crystal, a substance that is active electrochemically or when irradiated, lithographic resin, etc. It may be in the form of a liquid, a gel, a powder, or a heterogeneous phase.

During a preliminary step which is illustrated in FIG. 2*b*, a longitudinal ejection deviation is measured for each nozzle i, denoted $\delta l_i$ where i is from 1 to 8. The longitudinal deviation $\delta l_i$ between the outlets of nozzles 1 to 8 and the receiving surface of the medium 100 is measured parallel to the longitudinal direction L at the medium 100, meaning for the ejection distance which will be adopted for the actual deposition. This ejection distance, denoted d, may be 0.1 mm (millimeters) for example. For this preliminary step, the medium 100 may be replaced by a test medium 200 facing the nozzle outlets of the head 10 at the same ejection distance d. The preliminary step may then comprise the following sub-steps:

/1a/ with the head 10 facing the test medium 200, activating each nozzle i so that it ejects the amount of substance onto the test medium 200; then /1b/ measuring the respective longitudinal deviations $\delta l_1$, $\delta l_2$, $\delta l_3$, . . . of nozzles 1, 2, 3, . . . by using a scanner.

In substep /1a/, the amount of substance ejected by the nozzle i reaches the test medium 200 at the point of impact which is denoted $P_i$. The longitudinal deviation $\delta l_i$ is the length of the segment connecting the perpendicular projection of the outlet of the nozzle i onto the test medium 200, to the point of impact $P_i$. It is defined algebraically: for example each longitudinal deviation $\delta l_i$ is positive when oriented towards the top of the head 10, and negative when oriented towards the bottom of the head 10. In addition, the exact position of the head 10 facing the medium 100 or test medium 200 can be precisely defined in various ways. For example, the head 10 may be equipped with an optical detector 11, and the positions of the outlets of the nozzles 1, 2, 3, . . . precisely known relative to this. The detector 11 may be used to define the positions of the edges of the medium 100 or test medium 200, then the head 10 is controlled so that it moves to face a defined location of the medium 100 or test medium 200. The displacement distances of the head 10 are controlled with sufficient accuracy using a means known to a person skilled in the art.

The use of a scanner for substep /1b/ is particularly advantageous for simultaneously measuring all ejection deviations of the nozzles with a high level of precision. It is possible to increase this precision by compensating for variations in the scanning rate of the scanner in the longitudinal direction L during substep /1b/.

In a preferred implementation of the invention which will be described below, a transverse ejection deviation $\delta t_i$ may also be measured for each nozzle i. As is shown in FIG. 2*c*, the transverse deviation $\delta t_i$ is measured parallel to the transverse direction T, between the perpendicular projection of the outlet of the nozzle i onto the test medium 200, and the point of impact $P_i$. In particular, substeps /1a/ and /1b/ allow simultaneously measuring the longitudinal deviations $\delta l_i$ and the transverse deviations $\delta t_i$, without increasing the total duration of the method.

The longitudinal deviations $\delta l_i$, and possibly the transverse deviations $\delta t_i$, are stored.

Figure 3:
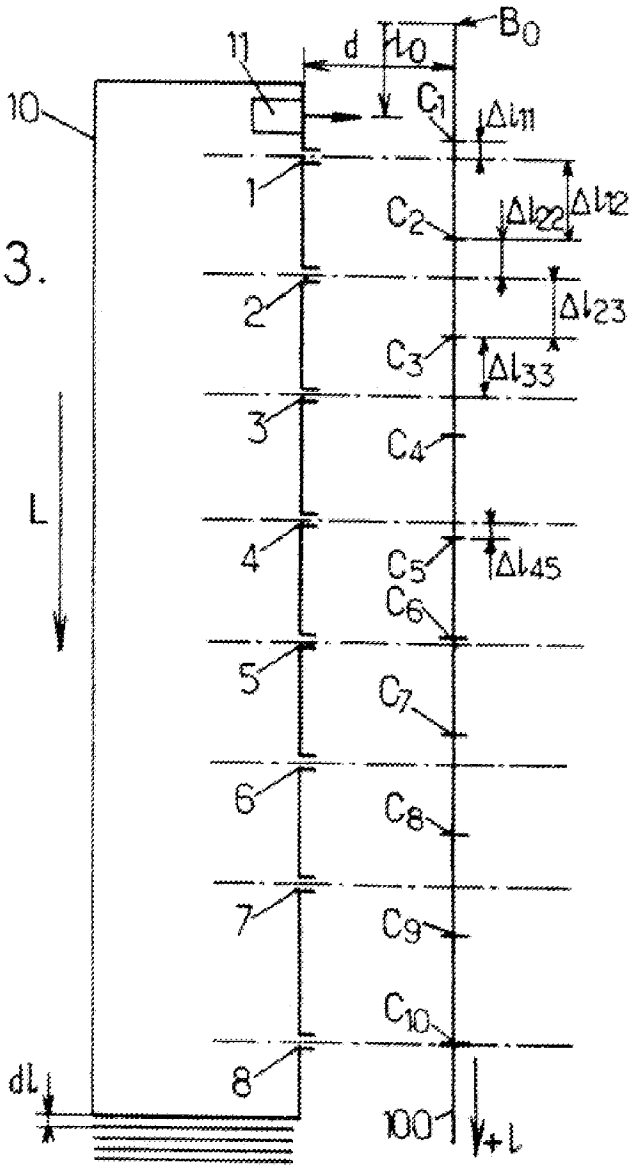
FIG. 3 illustrates deposition parameters of a method of the invention.

As shown in FIG. 3, next a set of target points $C_1$, $C_2$, $C_3$, . . . on the medium 100 is determined, where amounts of substance are to be deposited. The target points are offset from each other in the longitudinal direction L. These target points may have a fixed distance between neighboring target points in the direction L. This is the case in particular when the deposition is to be made in a matrix of points. This offset between neighboring target points has no relation to the distance between two neighboring nozzles of the head 10.

Initially and for clarity in the description, it is assumed that the target points $C_1$, $C_2$, $C_3$, . . . are aligned in the longitudinal direction L. It is also assumed that the transverse deviations $\delta t_i$ are zero or that no deposition precision criterion is applied in the transverse direction T.

The head 10 is brought into alignment with the set of target points $C_1, C_2, C_3, \ldots$ in the transverse direction T, for example near $B_0$ at the top of the medium 100, then successive offsets of the head 10 relative to the medium 100 are ordered, parallel to the longitudinal direction L. In other words, the head 10 is moved relative to the medium 100 to reach an initial longitudinal offset of the head which is denoted $l_0$, then in successive increments in the longitudinal direction L to reach subsequent longitudinal offsets of the head relative to the initial offset $l_0$. All the successive increments are equal and denoted dl, l being a longitudinal coordinate indicating the position of the head 10 relative to the medium 100 in the direction L (FIG. 3). The increment dl is chosen to be sufficiently small relative to the desired accuracy in direction L for the position of the deposited amounts of substance. For each longitudinal offset performed for the head 10, each individual nozzle i has a known offset to one of the target points. For example, the outlet of nozzle 1 has an offset $\Delta l_{11}$ to target point $C_1$, an offset $\Delta l_{12}$ to target point $C_2$, etc., and similarly for nozzle 2: an offset $\Delta l_{21}$ to target point $C_1$, an offset $\Delta l_{22}$ to target point $C_2$, $\Delta l_{23}$ to target point $C_3$, etc. More generally, $\Delta l_{ij}$ is the longitudinal offset between the outlet of nozzle i and the target point $C_j$. These longitudinal offsets of the nozzles are incremented by dl at each displacement of the nozzle 10: $\Delta l_{ij}$ decreases while the outlet of nozzle i is above target point $C_j$, then increases when the outlet of the same nozzle i has moved below the target point $C_j$. As dl is repeatedly incremented in order to traverse the entire length of the medium 100 in the longitudinal direction L, the nozzle i is only activated when one of the offsets $\Delta l_{ij}$ is substantially equal to the opposite of the longitudinal deviation $\delta l_i$ of the nozzle i. The longitudinal deviation $\delta l_i$ is thus compensated for by the offset $\Delta l_{ij}$, such that the point of impact $P_i$ of the amount of substance ejected by the nozzle i onto the medium 100 is superimposed on the target point $C_j$.

More generally, it is determined by computer which of the nozzles i have outputs presenting longitudinal offsets $\Delta l_{ij}$ for certain target points $C_j$ which are the opposite of the longitudinal deviations $\delta_i$, for each value of the longitudinal coordinate l of the position of the head 10. Then these nozzles are selected for this value of the coordinate l, and they are saved electronically with the amounts of substance to be ejected for each nozzle selected. Nozzle selections are therefore made for all values of the longitudinal coordinate l which are equal to n×dl, n being an integer. This process is continued, for example from the top to the bottom of the medium 100.

Then the head 10 is placed facing the medium 100 at the initial offset $l_0$ of the head then successively at the longitudinal offsets incremented by dl. Each time, only the nozzles selected for the current value of the longitudinal coordinate l are activated to deposit portions of substance onto the medium 100, in the stored quantities.

For example, the increment dl may be equal to 10 μm, or 1 μm, particularly when the nozzle outlets are separated by 169 μm in the longitudinal direction L.

Preferably, the increment dl may be a divisor of a longitudinal step distance for the head 10 which corresponds to a distance between extreme nozzles of the head 10 which are longitudinally opposite in direction L, while being less than the distance between two neighboring nozzles in the same direction L. Two different nozzles of the head 10 may then respectively deposit portions of the substance at the same target point on the medium 100, at two different positions of the head 10 in the direction L, for example to obtain a higher contrast. The longitudinal step distance for the head 10 is also the distance the head 10 is shifted in direction L, so that the outlet of nozzle 1 arrives at dl below the outlet of nozzle 8. These two positions of the head 10 then allow depositing the substance onto the medium 100 in a segment parallel to the direction L, with a density of deposited substance which is constant along the segment.

Figure 4:
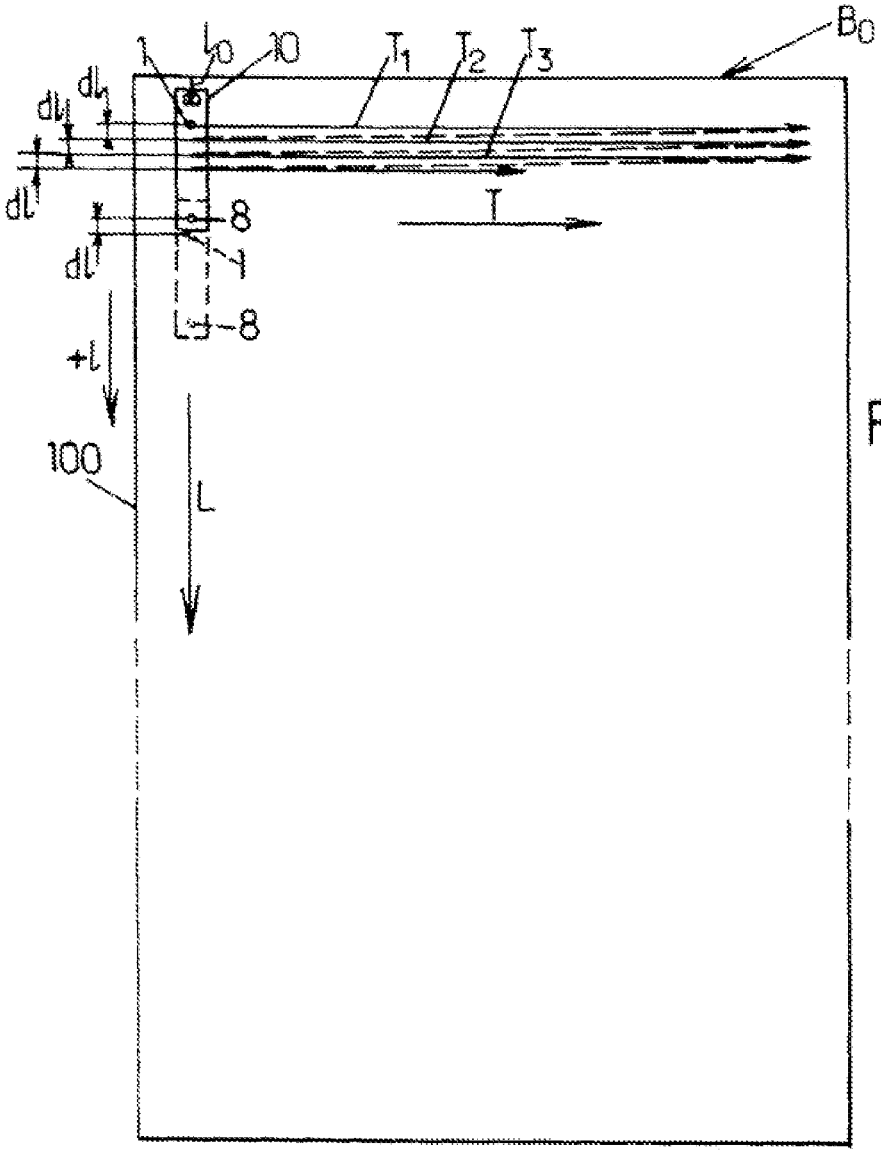
FIG. 4 illustrates a continuation of a deposition method of the invention.

For most applications of the invention, the substance must be deposited at locations on the medium 100 which are offset from each other not only in the longitudinal direction L but also in the transverse direction T. In this case, the head 10 is moved in the two directions T and L facing the medium 100. Such a two-dimensional displacement can be achieved by moving the head 10 in the transverse direction T, from each position of the head 10 successively offset by the increment dl in the longitudinal direction L as described above. FIG. 4 illustrates such a path for the head 10, consisting of a succession of rectilinear paths $T_1, T_2, T_3, \ldots$, parallel to the direction T and progressively offset by the increment dl in the direction L. During each of the paths $T_1, T_2, T_3, \ldots$, the only nozzles activated are those which have been selected for the value of the longitudinal offset I corresponding to this path. In addition, they are activated for the amounts of substance to be deposited at the initially set target points on this path.

When the transverse ejection deviations $\delta t_1, \delta t_2, \delta t_3, \ldots$ have been measured, they can be compensated for by activating each nozzle selected for the longitudinal offset from a path, at a selected moment during the travel along this path. This moment is when the nozzle has a transverse offset relative to a target point which is opposite the transverse deviation of the nozzle concerned. In this manner, the amount of substance is deposited exactly at the target point, with no perceptible deviation between the point of impact and the target point in the two directions T and L. In general, the travel along each of the paths $T_1, T_2, T_3, \ldots$ occurs in a continuous movement of the head 10, and the selected nozzle is activated during this movement without stopping the head.

When the deposition area on the medium 100 is longer in the longitudinal direction L than the distance between the nozzles 1 and 8 of the head 10 in the same direction L, the sequence of longitudinal offsets of the head 10 which has been described, using the increment dl, is continued with the nozzle 1 in the subsequent positions of the head 10 beyond the initial position of the nozzle 8 (see the subsequent position of the head 10 represented with dotted lines in FIG. 4). The distance between the initial position of the head 10, represented as a solid line, and its subsequent position represented with dotted lines, is the longitudinal step distance for the head 10 in the direction L, to allow regular deposition throughout the deposition area.

In particular, the invention allows making deposits of a uniform density of the amount of substance deposited, to cover large surface areas.

In general, a compromise may be searched for between a value of the increment dl for the longitudinal offset of the head 10 which is not too low, and an accepted tolerance for the accuracy of the coincidence between the points of impact and the target points in the longitudinal direction L. The number of transverse paths can thus be reduced to the value necessary to obtain the desired deposition quality throughout the deposition area. Such a compromise can be found automatically using optimization software, based on initially measured values for the longitudinal ejection deviations of all the nozzles.

Figure 5:
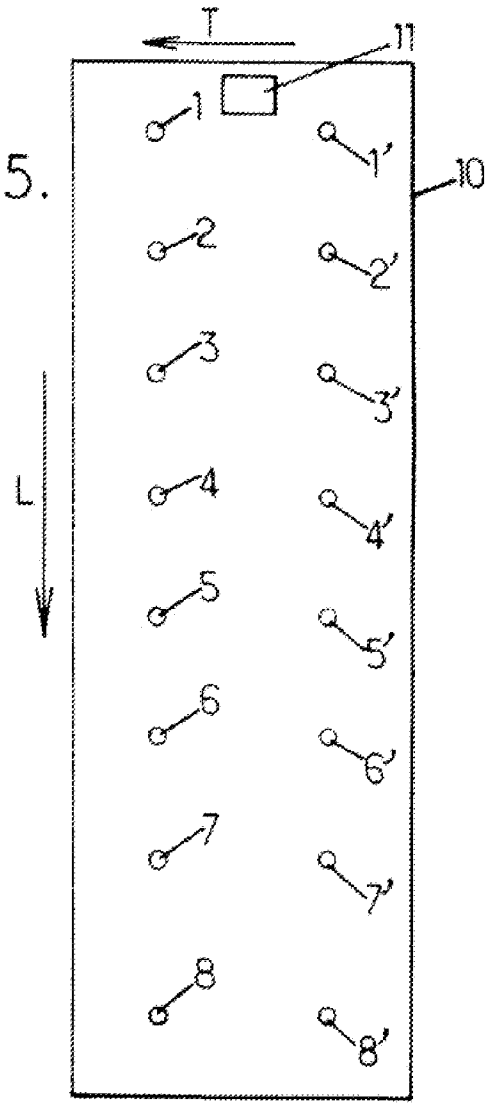
FIG. 5 corresponds to FIG. 2*a* for another deposition head which can be used to implement the invention.

It is understood that the invention may be applied to a head 10 which comprises several columns of nozzles, as represented in FIG. 5. In this figure, two columns of nozzles illustrated, respectively denoted 1, 2, . . . , 8 and 1', 2', . . . , 8', but it is understood that there may be any number of columns of nozzles, and each column may have any number of nozzles. In addition, the nozzles of the head are not necessarily aligned in columns parallel to the longitudinal direction L, but may be offset in any manner in the transverse direction T, in addition to their distribution in the longitudinal direction L. The invention, which consists of compensating for the longitudinal ejection deviation of each nozzle, and possibly also its transverse ejection deviation, applies identically to all nozzles regardless of their distribution on the head 10.

Depositions have been made on media 100 as represented in FIGS. 1*a* and 1*b*, with separated cells 101 arranged side by side in a random manner. With the invention, amounts of substance could be deposited in all the cells 101 in target amounts that were set initially, without having to take into account the positions or boundaries between cells 101 when programming each deposition sequence. After deposition in this manner, each medium 100 has the desired variations in the amount of substance deposited along its surface, with no presence of unwanted moiré patterns.

The invention claimed is:

1. A method for depositing a substance onto a receiving medium for said substance, by ink-jet printing using a head which is movable relative to the medium in a transverse direction and in a longitudinal direction perpendicular to said transverse direction, said head including at least one set of multiple ejection nozzles which are longitudinally offset relative to each other and which are each adapted to eject amounts of the substance in the direction of the medium with a fixed distance between said nozzle and said medium, the method comprising:

for each nozzle, measuring a longitudinal deviation between a point of impact on the medium of an amount of substance ejected by the nozzle, and a position in the longitudinal direction of said nozzle when said nozzle ejects said amount of substance;

determining a set of target points distributed in the longitudinal direction on the medium, at which amounts of substance are to be deposited;

for an initial longitudinal offset of the head relative to the medium, parallel to the longitudinal direction, selecting those of the nozzles which have respective offsets in the longitudinal direction relative to certain target points, substantially opposite the respective longitudinal deviations of said nozzles, such that the points of impact on the medium of the amounts of substance ejected by the selected nozzles coincide with the corresponding target points parallel to said longitudinal direction;

repeating the selecting step for a number of iterations while varying each iteration the longitudinal offset of the head beyond said initial longitudinal offset, by an increment of said longitudinal offset of the head that is less than or equal to the distance between two neighboring target points;

placing the head facing the medium at the initial longitudinal offset, and activating the selected nozzles in accordance with predetermined amounts of substance to be deposited on the medium at said target points; and repeating the placing and activating steps for each longitudinal offset of the head, wherein each iteration of placing the head includes moving the head parallel to the transverse direction, and the nozzles selected for the longitudinal offset of the head occurring during said iteration are activated during the transverse movement of the head according to predetermined amounts of substance to be deposited on the medium at transverse offset locations, the nozzles not selected for said longitudinal offset of the head not being activated during said transverse movement of the head.

2. A method according to claim 1, wherein the target points are distributed with a fixed spacing between two neighboring target points parallel to the longitudinal direction.

3. A method according to claim 1, wherein the increment used for the longitudinal offset of the head when repeating the selecting step is a divisor of a longitudinal step distance corresponding to a distance between extreme nozzles of the head that are opposite in the longitudinal direction, and is less than the distance between two neighboring nozzles of said head in said longitudinal direction.

4. A method according to claim 1, wherein the increment used for the longitudinal offset of the head when repeating the selecting step is less than or equal to 10 μm.

5. A method according to claim 4, wherein the increment for the longitudinal offset of the head is less than or equal to 1 μm.

6. A method according to claim 1, wherein:

the measuring includes measuring a transverse deviation for each nozzle, between the point of impact on the medium of the amount of substance ejected by said nozzle and the position of said nozzle when said nozzle ejects said amount of substance, in the transverse direction;

the target points determined during the determining step are offset on the medium parallel to the transverse direction;

each iteration of placing the head includes transversely moving the head, each nozzle selected for the longitudinal offset of the head occurring in said iteration is activated according to the predetermined amount of substance to be deposited on the medium at one of the target points, at a moment in said transverse movement at which said selected nozzle has a transverse offset relative to said target point, which is substantially opposite the transverse deviation of said selected nozzle, such that the point of impact on the medium of the amount of substance ejected by said selected nozzle coincides with said target point simultaneously in both the longitudinal directions.

7. A method according to any claim 1, wherein a length of the medium in the longitudinal direction is greater than a longitudinal step distance corresponding to a distance between the extreme nozzles of the head that are longitudinally opposite in said longitudinal direction, and wherein the placing includes adding said longitudinal increment to the longitudinal offsets of the head.

8. A method according to claim 1, wherein the head comprises several sets of nozzles where all nozzles together in each set are offset parallel to the transverse direction, and wherein each iteration of the selecting, placing, and activating steps is executed by selecting or activating some of the nozzles in all sets of nozzles, if the respective longitudinal offsets in the longitudinal direction of said nozzles relative to certain target points are substantially opposite the respective longitudinal deviations of said selected nozzles.

9. A method according to claim 1, wherein the medium receiving the substance is equipped with cells arranged side by side in a plane parallel to the transverse and longitudinal directions, and which are adapted to individually contain a variable amount of the substance.

10. A method according to claim 9, wherein the cells have dimensions parallel to the transverse and longitudinal directions that are greater than 40 μm.

11. A method according to claim 9, wherein the cells are separated from each other by a network of walls, each wall extending perpendicularly to the transverse and longitudinal directions, in a network pattern corresponding to each cell in a plane parallel to said transverse and longitudinal directions, that is irregular, random, or pseudo-random.

12. A method according to claim 1, wherein the measuring includes:

with the head facing a test medium that will receive the substance, activating each nozzle so that said nozzle ejects the amount of substance onto the test medium; then measuring the respective longitudinal deviations of the nozzles by using a scanner.

13. A method according to claim 12, wherein variations in a scanning rate of the scanner, in the longitudinal direction, are compensated for during measuring the respective longitudinal deviations of the nozzles using the scanner.

* * * * *